United States Patent [19]

Pere

[11] 4,440,615

[45] Apr. 3, 1984

[54] FILTER-PRESS TYPE ELECTROLYZER

[75] Inventor: Gérard Peré, Le Breuil, France

[73] Assignee: Creusot-Loire, Paris, France

[21] Appl. No.: 403,684

[22] Filed: Jul. 30, 1982

[30] Foreign Application Priority Data

Sep. 30, 1981 [FR] France ..... 81 18421

[51] Int. Cl.[3] ..... C25B 9/00; C25C 7/00; C25D 17/00

[52] U.S. Cl. ..... 204/253; 204/283; 204/288

[58] Field of Search ..... 204/253–258, 204/282–284, 286, 8, 9, 279, 290 G

[56] References Cited

FOREIGN PATENT DOCUMENTS

| | | | |
|---|---|---|---|
| 2416274 | 2/1978 | France . | |
| 2388060 | 11/1978 | France . | |
| 2448582 | 10/1980 | France | 204/254 |
| 2460341 | 2/1981 | France | 204/266 |
| 54-46180 | 4/1979 | Japan | 204/284 |
| 56-38485 | 4/1981 | Japan | 204/252 |
| 148552 | 1/1955 | Sweden | 204/253 |
| 752486 | 7/1956 | United Kingdom | 204/283 |

*Primary Examiner*—Howard S. Williams
*Assistant Examiner*—T. L. Williams
*Attorney, Agent, or Firm*—Pollock, Vande Sande & Priddy

[57] ABSTRACT

A filter-press type electrolyzer equipped with electrodes consisting of solid metal plates (2), called "plate electrodes", and of latticed or perforated plates (5, 6), called "pre-electrodes", parallel to the plate electrodes and separated from the latter by bracing tongues (7), the pre-electrodes enclosing a diaphragm (4) for each cell.

The pre-electrodes are equipped with solid strips (61, 62, 63), which are all parallel to one another and parallel to the welding direction; each bracing tongue (72) has the shape of an S and is welded to the associated pre-electrode on a solid strip (62) of the latter and to the associated plate electrode, so as to leave a slight gap (J) from the tongue (71), located in quasi-continuous manner on the opposite face of said plate electrode, and the bracing tongues are placed in a staggered arrangement, as viewed in a plane parallel to the electrodes.

4 Claims, 3 Drawing Figures

FILTER-PRESS TYPE ELECTROLYZER

FIELD OF THE INVENTION

The present invention relates to a filter-press type electrolyzer equipped with bipolar electrodes provided with "pre-electrodes" in the form of grids or perforated plates, which are applied against opposite faces of each diaphragm.

SUMMARY OF THE INVENTION

Such electrolyzers having electrodes provided with "pre-electrodes" are familiar to those skilled in the art and are described, for example, in French Pat. Nos. 2,388,060, 2,416,274 and 2,448,582. The present invention concerns an electrolyzer of this type, in which the electrodes consist of solid metal plates, whereas the pre-electrodes consist of latticed or perforated plates, parallel to the plate electrodes and separated from the latter by bracing tongues, said electrolyzer having a definitely improved design by comparison with known electrolyzers, such as that described in applicant's French Patent Specification No. 2,448,582 both from the point of view of ease of manufacture and from the point of view of preventive measures against corrosion. In this electrolyzer, the pre-electrodes are equipped with solid strips, which are all parallel to one another and parallel to the welding direction, each bracing tongue has the shape of an S and is welded, on the one hand, to the associated pre-electrode on a solid strip of the latter and, on the other hand, to the associated plate electrode, so as to leave a slight gap from the tongue, located in quasi-continuous manner on the opposite face of said plate electrode, and the bracing tongues are placed in staggered arrangement, as viewed in a plane parallel to the electrodes.

BRIEF DESCRIPTION OF THE DRAWINGS

The invention will be understood more clearly with the aid of the following description with reference to the attached drawings, in which.

DETAILED DESCRIPTION

Figure 1:
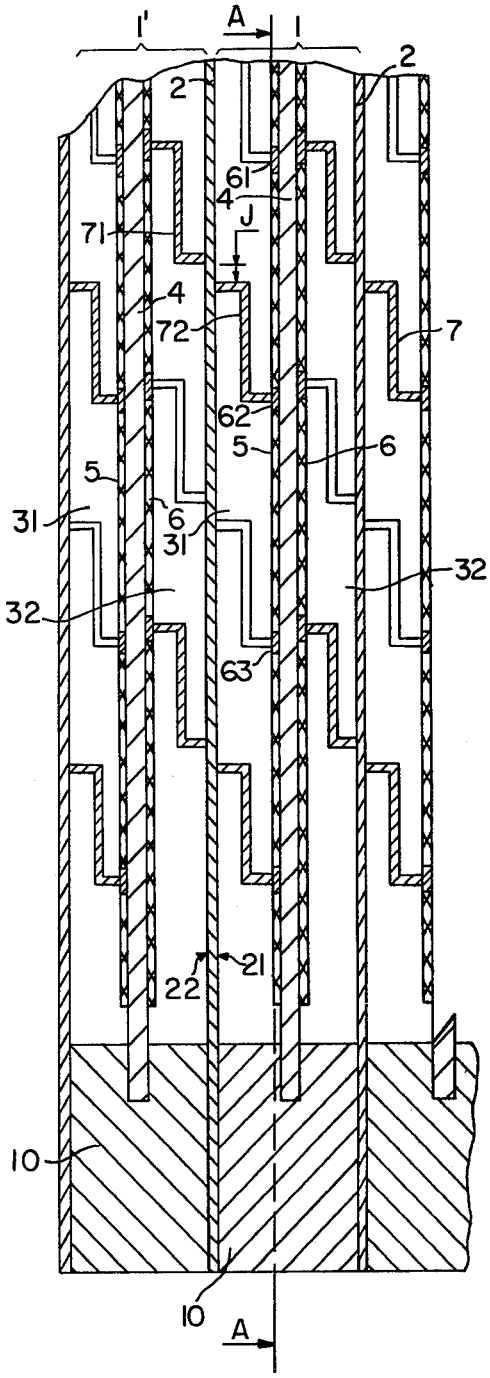
FIG. 1 is a view in partial vertical section of an electrolyzer in accordance with the invention in the direction B—B of FIG. 2.
Figure 2:
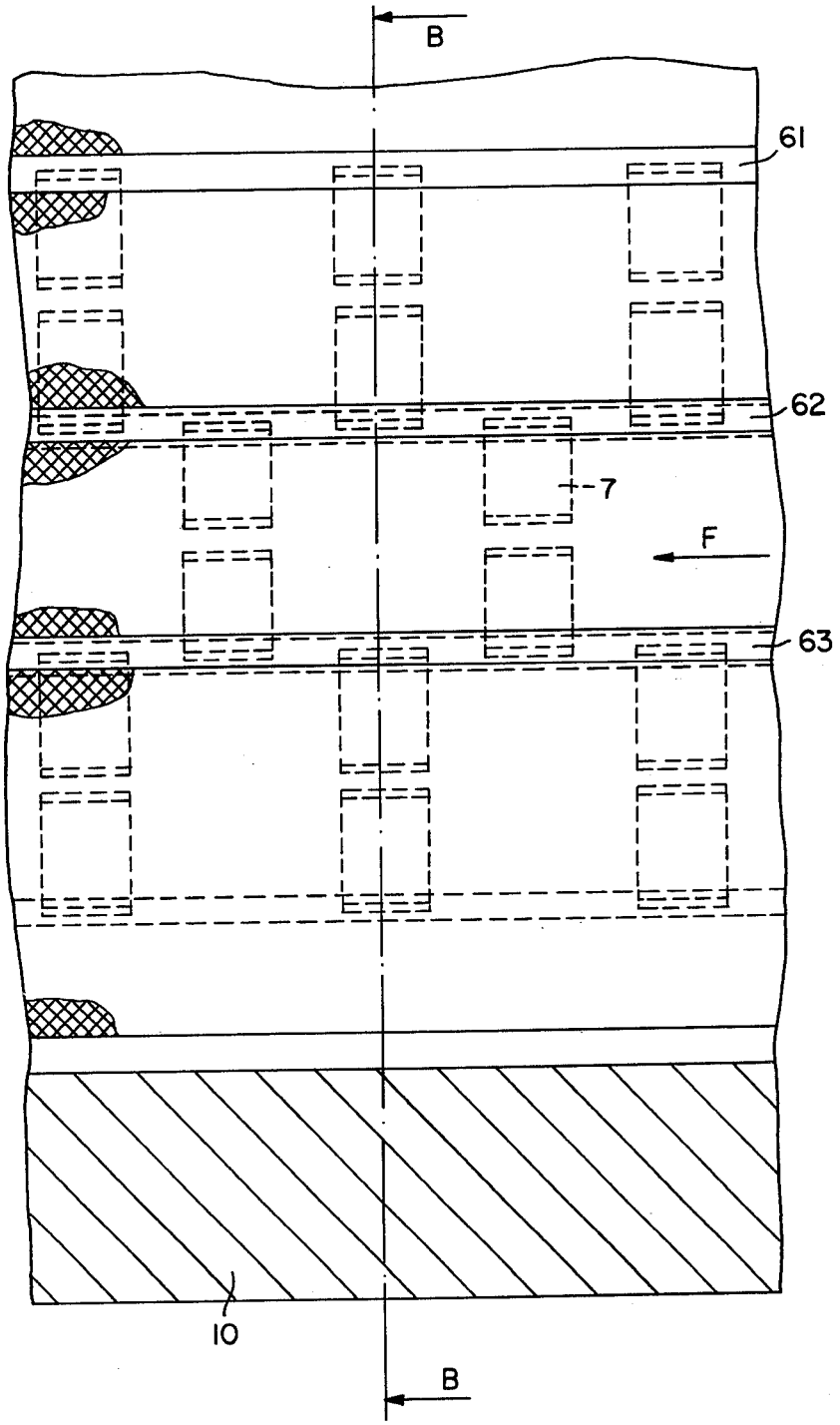
FIG. 2 is a view in transverse section in the direction A—A of FIG. 1.

With reference to FIGS. 1 and 2, the electrolyzer comprises a stack of insulating frames 10, usually called "bracing joints", which are shown in part. Electrolysis cells are housed on the inside of this stack of insulating frames 10. These cells, shown in part, are marked, for example, 1 or 1' in FIG. 1.

Each cell is bounded by two flat plate electrodes 2. Each plate electrode 2 is made of metal and has a low thickness. It is wetted on its two opposite faces 21 and 22 by the electrolyte. Each plate electrode 2 is bipolar. One of its faces, for example 21, is an anode, at which oxygen is formed, the opposite face 22 then being a cathode, at which hydrogen is formed. It is made, for example, of nickel. Each cell is divided into two compartments 31 and 32 by a diaphragm 4. The compartment 31, located on the side of the face 21, contains the anolyte, the compartment 32, located on the side of the face 22, containing the catholyte.

Each diaphragm 4 is stretched across the inner space of a bracing frame 10. It is produced, for example, with the aid of an asbestos cloth.

Moreover, each cell comprises two plate electrodes 5 and 6, usually called "pre-electrodes", which are placed on either side of the diaphragm 4 of that cell so as to lie flat against that diaphragm and at a certain distance from the two plate electrodes 2, which bound that cell. Each plate pre-electrode 5 or 6 is composed of a discontinuously expanded metal sheet such that the pre-electrode obtained appears as a sheet of expanded metal, provided at regular intervals with solid metal strips 61, 62, 63 of small width and parallel to the horizontal plane. It is produced, for example, from nickel steel. Each plate electrode 2 is housed between a plate 5, called pre-electrode, of one cell and a plate 6, called pre-electrode, of the adjacent cell. Each diaphragm 4 is enclosed between the two pre-electrodes 5 and 6, which contribute to its support.

As in the case of the electrolyzer according to French Patent Specification No. 2,448,582 mentioned above, the plate pre-electrodes are connected to the plate electrodes by bracing tongues 71, 72 which are all identical but, in accordance with the present invention, have the shape of an S, as is seen in FIG. 1, which makes it possible to avoid the creation of sharp edges that promote corrosion. As is seen in FIG. 2, the bracing tongues, viewed in a plane parallel to the electrodes, are placed in staggered arrangement. They are welded, at one of their two ends, to the pre-electrodes 2 on the metal strips such as 61 and, at their other end, onto the corresponding pre-electrode 2. As is clearly seen in FIG. 1, the ends of the two bracing tongues 71, 72, located in the vertical section on either side of the same plate electrode 2 in quasi-continuous fashion are welded onto that plate 2 at a slight interval J. It will be observed that the assembly of tongues such as 71 and the assembly of tongues such as 72, which are located on either side of each plate electrode 2, necessarily form, because of the S-shape of the tongues, staggered arrangements, offset to one another in the plane parallel to the electrodes, which is particularly advantageous from the point of view of the flexibility and automatic readjustment of the stacking sets.

This method of construction possesses the enormous advantage of enabling welding to be carried out by line projection, both on the solid strips, such as 61, of the pre-electrodes and on the plate electrodes, welding by line projection being effected, for example, by means of a beam of electrons in a direction parallel to the strips 61, 62, 63, such as indicated by the arrow F of FIG. 2.

Figure 3:
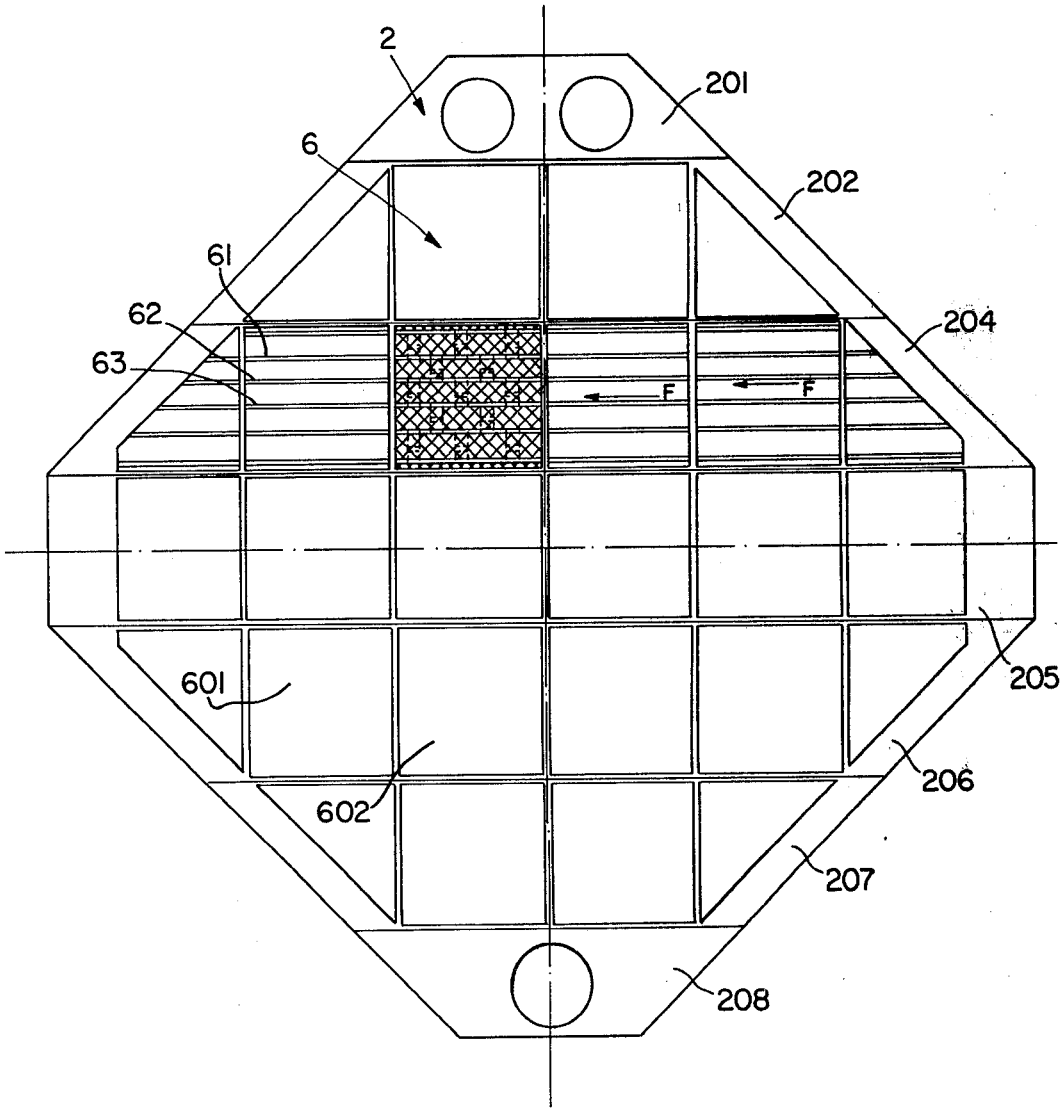
FIG. 3 is a diagrammatic view in transverse section of one of the cells of an electrolyzer having large dimensions and being in accordance with the invention.

Referring now to FIG. 3, an electrolyzer of large dimensions is shown, on which a plate electrode 2 and a plate pre-electrode 6 are seen. The plate pre-electrode 6, in this case, consists of an assembly of sheets 601, 602, etc., at least one side of which is parallel to the welding direction F, the facing sheets having a square shape and the side sheets being optionally cut off so as to give the exterior shape of the pre-electrode 6. The solid electrode 2 consists of an assembly of strips 201, 202, 204, 205, 206, 207, 208, having a width substantially equal to the height of the sheets 601, 602, etc., with the exception of the outermost strips 201, 208, and joined together by welding along the welding line F by projection through the bracing tongues, i.e., parallel to the strips 61, 62, 63, etc.

I claim:

1. A filter-press type electrolyzer housing a plurality of cells and equipped with electrodes consisting of solid metal plates (2), called "plate electrodes", and of latticed or perforated plates (5,6), called "pre-electrodes", parallel to said plate electrodes and separated from the latter by bracing tongues (71, 72), said pre-electrodes disposed along both sides of a diaphragm (4) for each cell, wherein said pre-electrodes are equipped with solid strips (61, 62, 63), which are all parallel to one another and parallel to the direction (F) in which said bracing tongues are welded to said pre-electrodes, each bracing tongue (72) having the shape of an S and being welded to the associated pre-electrode on a solid strip (62) of the latter, and to the associated plate electrode, so as to leave a gap (J) from the associated tongue (71), located on the opposite face of said plate electrode, and said bracing tongues being placed in staggered arrangement, as viewed in a plane prallel to said electrodes.

2. An electrolyzer as claimed in claim 1, wherein each said pre-electrode (6) consists of an assembly of sheets (601, 602 etc), at least one side of which is parallel to said welding direction (F).

3. An electrolyzer as claimed in claim 1 or claim 2, wherein each of said plate electrodes (2) consists of metal strips (201 to 208), which are parallel to said welding direction (F) and joined together by welding in said direction (F).

4. An electrolyzer as claimed in claim 2, wherein said strips (201 to 208), of which each said plate electrode (2) is composed, each has, with the exception of the outermost strips (201 and 205), a width substantially equal to the height of said sheets (601, 602 . . . ).

* * * * *